US010347453B2

(12) United States Patent
Oh

(10) Patent No.: US 10,347,453 B2
(45) Date of Patent: Jul. 9, 2019

(54) MULTI-POLE MOLDED CASE CIRCUIT BREAKER WITH INSULATION BARRIER FOR ROTARY PIN

(71) Applicant: LSIS CO., LTD., Anyang-si, Gyeonggi-do (KR)

(72) Inventor: Kyunghwan Oh, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/462,636

(22) Filed: Mar. 17, 2017

(65) Prior Publication Data

US 2018/0061601 A1 Mar. 1, 2018

(30) Foreign Application Priority Data

Aug. 31, 2016 (KR) ..... 20-2016-0005080 U

(51) Int. Cl.
*H01H 71/10* (2006.01)
*H01H 1/20* (2006.01)
(Continued)

(52) U.S. Cl.
CPC ..... *H01H 71/10* (2013.01); *H01H 1/2058* (2013.01); *H01H 71/0235* (2013.01); *H01H 9/48* (2013.01); *H01H 2050/028* (2013.01)

(58) Field of Classification Search
CPC .. H01H 71/1009; H01H 71/1045; H01H 9/48; H01H 1/2058; H01H 2050/028
See application file for complete search history.

(56) References Cited

U.S. PATENT DOCUMENTS 4,123,734 A 10/1978 Maier et al.
8,207,459 B2 * 6/2012 Bae ..... H01H 71/1009 200/50.32

(Continued)

FOREIGN PATENT DOCUMENTS

CN 102568949 A 7/2012
CN 103035452 A 4/2013

(Continued)

OTHER PUBLICATIONS

European Patent Office Application Serial No. 17158405.5, Search Report dated Sep. 28, 2017, 10 pages.

(Continued)

*Primary Examiner* — Felix O Figueroa
(74) *Attorney, Agent, or Firm* — K&L Gates LLP

(57) ABSTRACT

Provided is a multi-pole molded case circuit breaker (MCCB) with an insulation barrier for a rotary pin, in which an insulation barrier is provided in a rotary pin for inter-phase power transmission to prevent dielectric breakdown. The multi-pole MCCB includes a shaft assembly having a movable contactor and having a plurality of rotary pin holes formed in a penetrating manner, a base assembly to which the shaft assembly is rotatably accommodated to be coupled, a switching mechanism coupled to an upper portion of the base assembly and rotating the shaft assembly, a plurality of rotary pins coupled to the plurality of rotary pin holes in a penetrating manner, and an insulation barrier formed of an insulating material and covering the plurality of rotary pins.

8 Claims, 8 Drawing Sheets

(51) Int. Cl.

| | |
|---|---|
| ***H01H 71/02*** | (2006.01) |
| *H01H 9/48* | (2006.01) |
| *H01H 50/02* | (2006.01) |

(56) References Cited

U.S. PATENT DOCUMENTS

| | | | | |
|---|---|---|---|---|
| 8,648,270 | B2 * | 2/2014 | Kosyanchuk ..... | H01H 73/045 200/243 |
| 9,129,768 | B2 | 9/2015 | Dahl et al. | |
| 2015/0124376 | A1 | 5/2015 | Morita et al. | |

FOREIGN PATENT DOCUMENTS

| | | |
|---|---|---|
| EP | 2148351 | 1/2010 |
| JP | 3392442 | 3/2003 |
| JP | 2007250550 | 9/2007 |
| KR | 2019900013339 | 7/1990 |
| KR | 100222380 | 7/1999 |
| KR | 20030072916 | 9/2003 |
| KR | 200376453 | 2/2005 |
| KR | 100764067 | 10/2007 |
| KR | 1020110063053 | 6/2011 |
| KR | 101209782 | 12/2012 |
| KR | 1020130035742 | 4/2013 |
| KR | 20140070429 | 6/2014 |

OTHER PUBLICATIONS

Korean Intellectual Property Office Application No. 20-2016-0005080, Search Report dated Sep. 23, 2016, 3 pages.
Korean Intellectual Property Office Application No. 20-2016-0005080, Office Action dated Jun. 27, 2017, 5 pages.
Chinese Office Action for related Chinese Application No. 201710352357.X; action dated Sep. 19, 2018; (10 pages).

* cited by examiner

MULTI-POLE MOLDED CASE CIRCUIT BREAKER WITH INSULATION BARRIER FOR ROTARY PIN

CROSS-REFERENCE TO RELATED APPLICATION

Pursuant to 35 U.S.C. § 119(a), this application claims the benefit of earlier filing date and right of priority to Korean Application No. 20-2016-0005080, filed on Aug. 31, 2016, the contents of which are all hereby incorporated by reference herein in its entirety.

BACKGROUND OF THE INVENTION

1. Field of the Invention

The present disclosure relates to a multi-pole molded case circuit breaker (MCCB), and particularly, to a multi-pole MCCB with an insulation barrier for a rotary pin, in which an insulation barrier is provided in a rotary pin for inter-phase power transmission to prevent a dielectric breakdown phenomenon.

2. Background of the Invention

In general, an MCCB is an electric device for automatically breaking a circuit to protect the circuit and a load, in an electrically overload state or in the event of a short circuit accident.

The MCCB includes a terminal unit which may be connected to a power source side or a load side, a contact unit including a fixed contactor and a movable contactor which comes into contact with the fixed contactor or is separated therefrom to connect or separate a circuit, a switching mechanism moving the movable contactor to provide power required for opening and closing the circuit, a trip unit sensing an overcurrent or a short-circuit current on the power source side and inducing a trip operation of the switching mechanism, and an arc extinguishing unit for extinguishing an arc generated when a fault current is interrupted.

FIGS. 1 and 2 illustrate a related art multi-pole MCCB. Specifically, FIG. 1 is a cross-sectional view of the related art MCCB, and FIG. 2 is a perspective view illustrating a state in which an enclosure is removed. In FIG. 2, only two single-pole breaking unit of a three-pole MCCB is illustrated for the purposes of description.

The related art MCCB includes a fixed contactor 2*a* and a movable contactor 2*b* forming a contact unit provided to connect or break a circuit transmitted from a power source side to a load side, a switching mechanism unit 3 providing power for rotating the movable contactor 2*b*, an arc extinguishing unit 4 provided to extinguish an arc generated when a fault current is interrupted, and a detection mechanism unit 5 detecting an abnormal current.

Also, a multi-pole MCCB generally has a plurality of single-pole breaking units 6. That is, a 3-phase MCCB has three single pole breaking units 6. Each of the single pole breaking units 6 has the contact units 2*a* and 2*b* and the arc extinguishing unit 4 within a base assembly 7 formed of an insulating material. The plurality of single-pole breaking units 6 may be integrally formed, but, in general, separately configured in consideration of ease of utilization and maintenance.

Also, a pair of rotary pins 8 are provided to transmit power generated by the switching mechanism unit 3 installed in any one single-pole breaking unit (generally, an S pole placed in the middle portion) to another single pole breaking unit 6. The rotary pins 8 are inserted to be installed in a rotary pin hole 9*a* penetrating through a shaft assembly 9 in which the movable contactor 2*b* is installed, and has a length sufficient to be connected to each phase. Here, the rotary pins 8 connecting each phase are generally formed of steel to tolerate an operation load of the switching mechanism unit 3.

However, in the related art MCCB, when a breaking operation is performed, an arc having a high temperature and high pressure may occur and may be leaked through an empty space between components or through a gap formed by arc pressure generated during the breaking operation, and when such an arc reaches the rotary pin 8 formed of steel, a dielectric breakdown phenomenon may occur.

SUMMARY OF THE INVENTION

Therefore, an aspect of the detailed description is to provide a multi-pole molded case circuit breaker (MCCB) with an insulation barrier for a rotary pin, in which an insulation barrier is provided in a rotary pin connecting each phase to transmit power, thus preventing a dielectric breakdown phenomenon.

To achieve these and other advantages and in accordance with the purpose of this specification, as embodied and broadly described herein, a multi-pole molded case circuit breaker (MCCB) includes: a shaft assembly having a movable contactor and having a plurality of rotary pin holes formed in a penetrating manner; a base assembly to which the shaft assembly is rotatably accommodated to be coupled; a switching mechanism coupled to an upper portion of the base assembly and rotating the shaft assembly; a plurality of rotary pins coupled to the plurality of rotary pin holes in a penetrating manner; and an insulation barrier formed of an insulating material and covering the plurality of rotary pins.

Here, the rotary pin holes and the rotary pin may each be provided as a pair.

Also, the insulation barrier may include a pair of pipe parts formed in the form of a pipe to cover the pair of rotary pins and a plate part vertically connecting one ends of the pair of pipe parts.

Also, the plate part may have a cover part extending in a direction opposite to a direction of the pipe part along a circumference to cover a correction link connecting the pair of rotary pins.

A link insertion recess allowing the correction link to be inserted and fixed thereto may be formed on an inner side of the cover part.

Also, the cover part may have a cutaway part opening a portion of the cover part.

Also, the rotary pin holes may be formed to be greater than an outer diameter of the insulation barrier.

Also, a link circumference recess allowing a circumferential portion of the correction link to be inserted therein may be formed on an inner side of the cover part.

A lower link may be exposed to a lower side of the switching mechanism, and any one of the pair of rotary pins may be coupled to a hole of the lower link in a penetrating manner.

In the multi-pole MCCB having an insulation barrier for a rotary pin according to an embodiment of the present disclosure, since the insulation barrier is provided in the rotary pin for transmitting inter-phase opening and closing power, dielectric breakdown may be prevented.

Also, since the correction link installed to correct movement of the pair of rotary pins are insertedly fixed to a rear side of the insulation barrier, movement of the rotary pins may be stably supported.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIGS. 7A to 7C are views illustrating an insulation barrier for a rotary pin according to another embodiment of the present disclosure, in which FIGS. 7A and 7B are perspective views and FIG. 7C is a cross-sectional view of a central portion.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
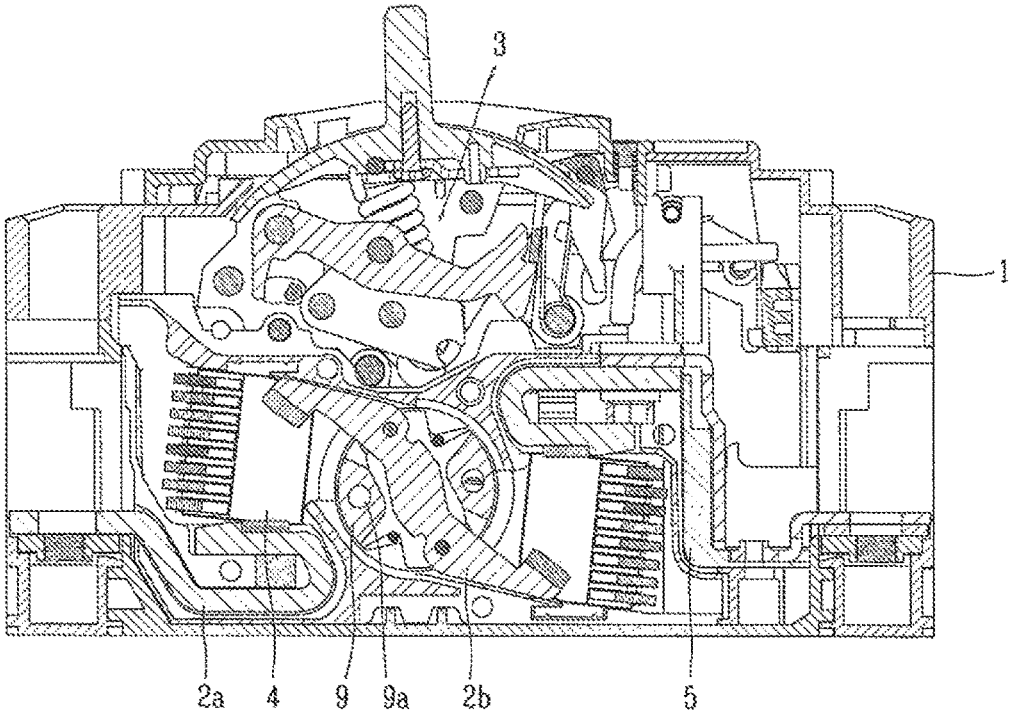
Fig. 1 Prior Art
FIG. 1 is a cross-sectional view of the related art multi-pole molded case circuit breaker (MCCB).
Figure 2:
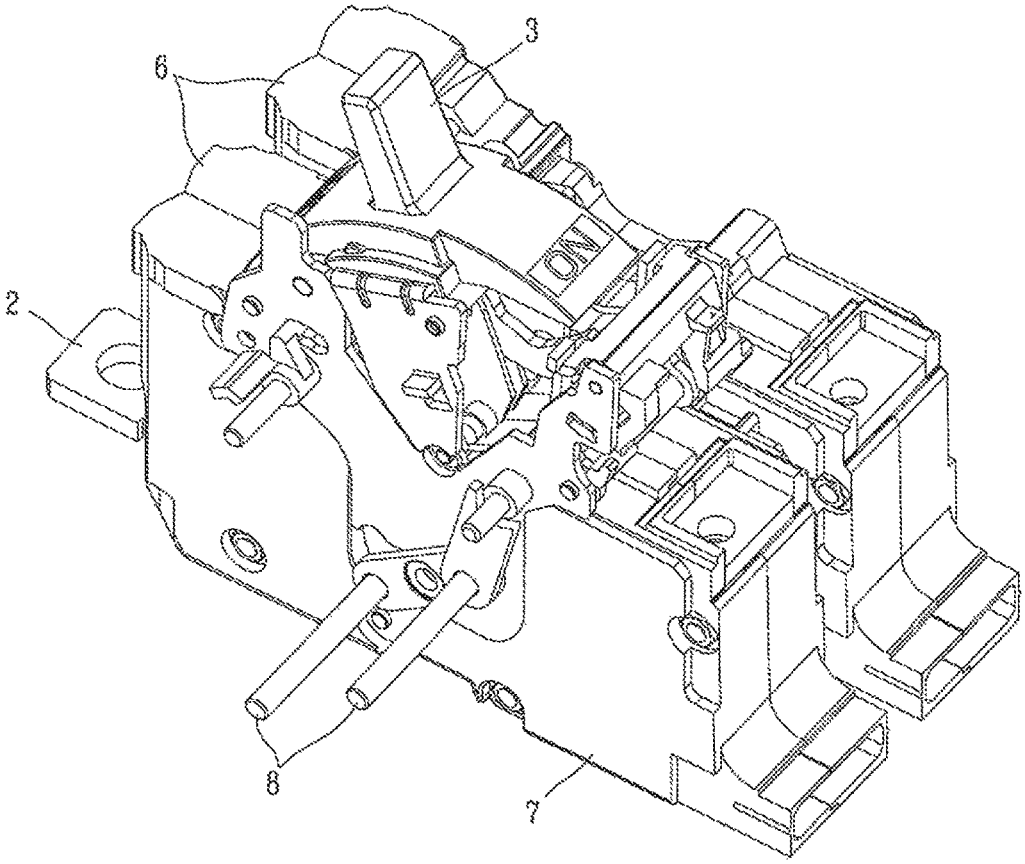
Fig. 2 Prior Art
FIG. 2 is a perspective view of a base assembly and a switching mechanism in the related art multi-pole MCCB.
Figure 3:
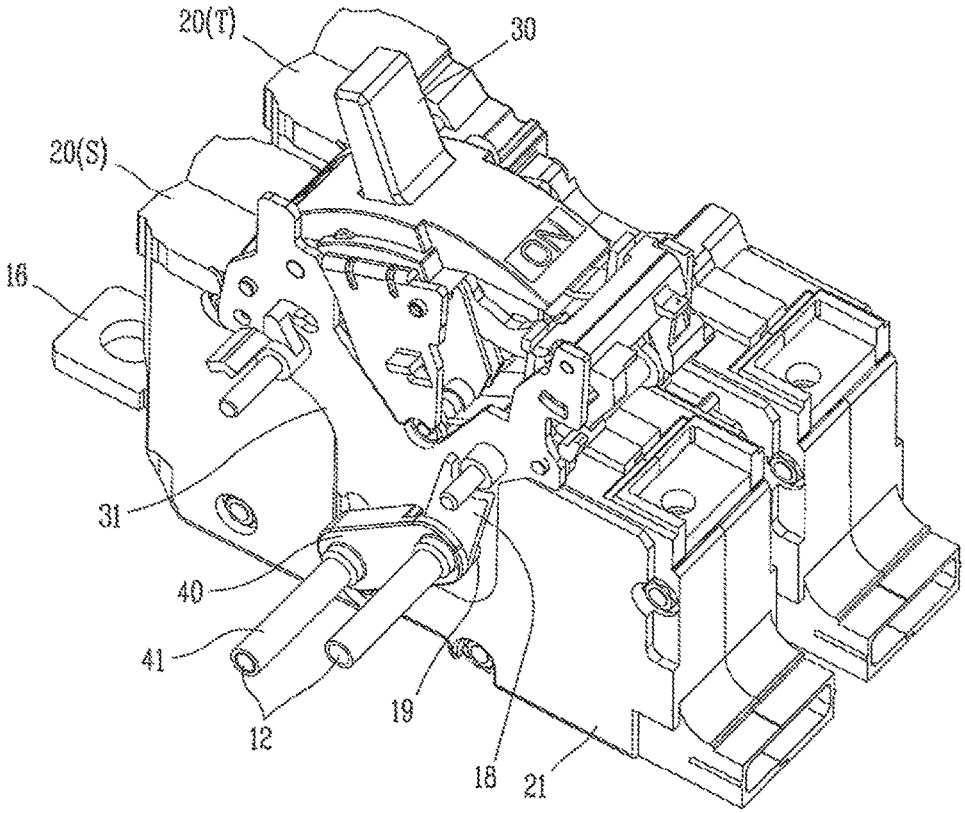
FIG. 3 is a perspective view of a base assembly and a switching mechanism in a multi-pole MCCB according to an embodiment of the present disclosure, in which only S and T-phase single pole breaking units, among three-phase single-pole breaking units, are illustrated.
Figure 4:
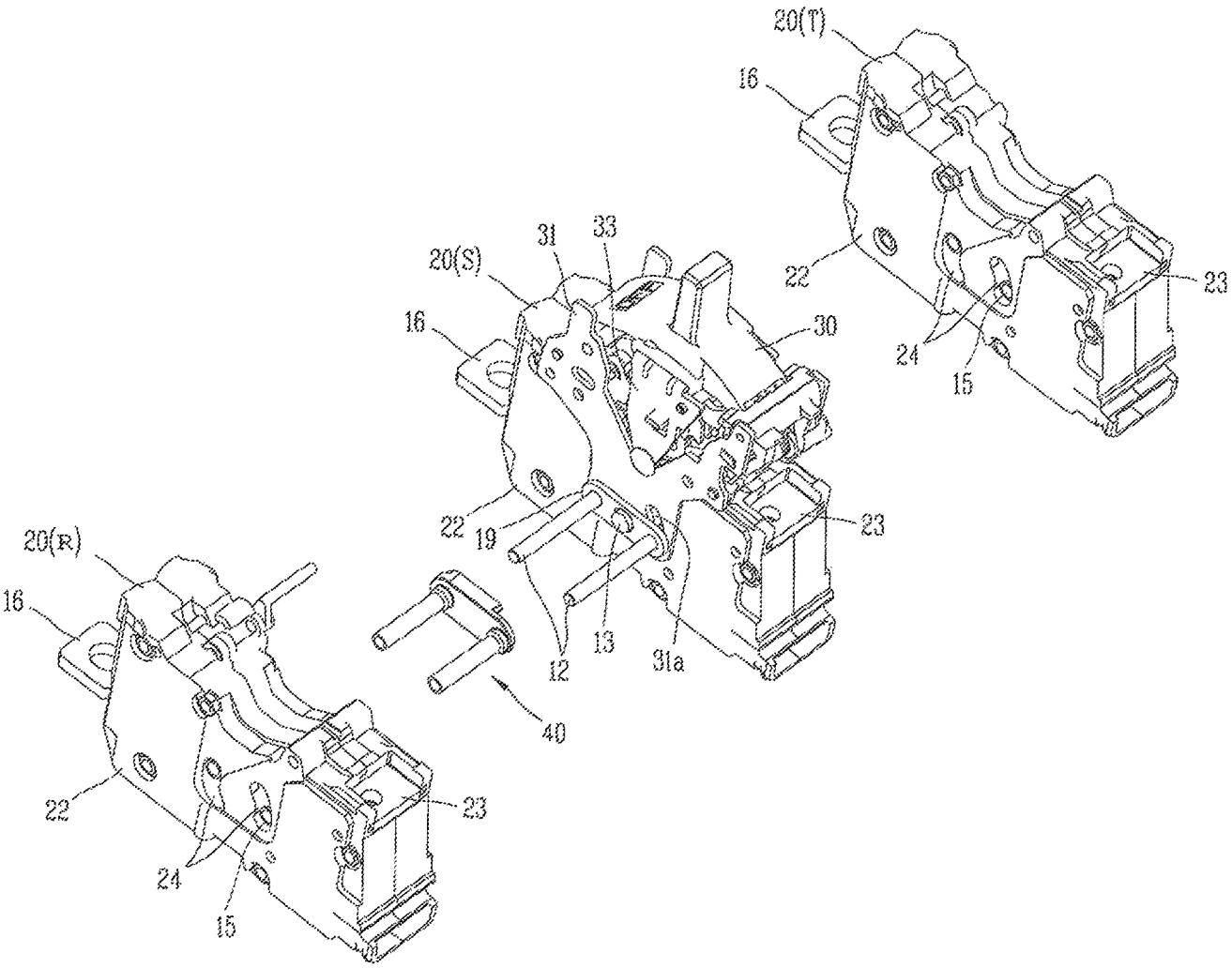
FIG. 4 is an exploded perspective view of FIG. 3, in which all the three-phase single-pole breaking units are illustrated.
Figure 5:
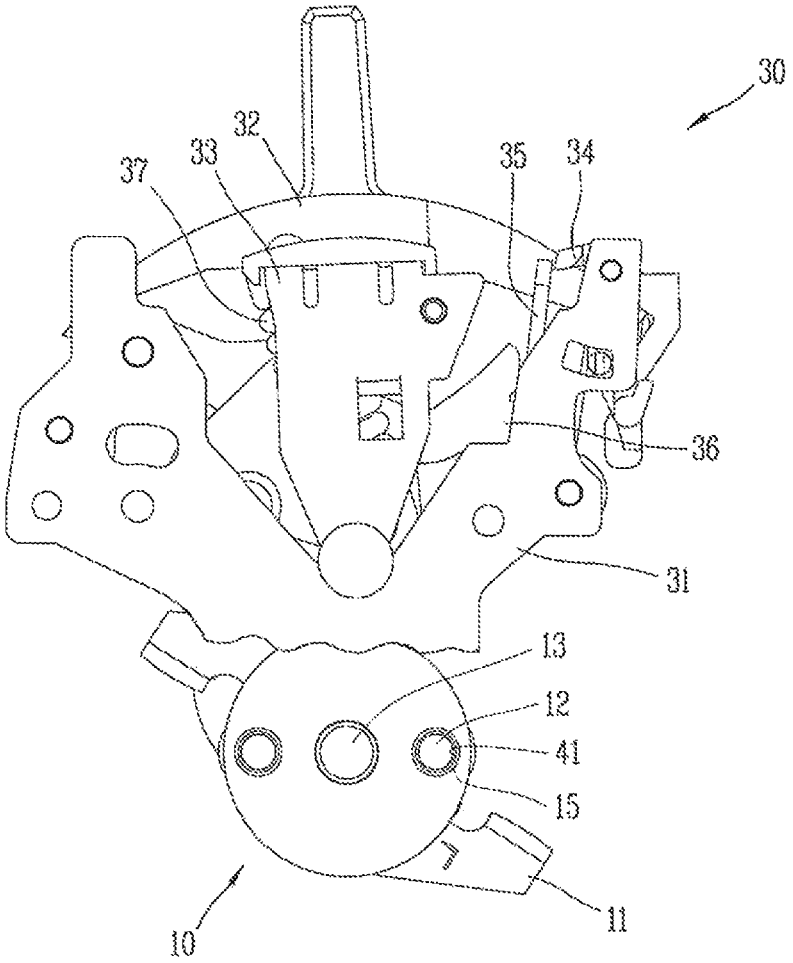
FIG. 5 is a side view of a switching mechanism unit of FIG. 3.

FIG. 3 is a perspective view of a base assembly and a switching mechanism in a multi-pole MCCB according to an embodiment of the present disclosure, in which only S and T-phase single pole breaking units, among three-phase single-pole breaking units, are illustrated. FIG. 4 is an exploded perspective view of FIG. 3, in which all the three-phase single-pole breaking units are illustrated. FIG. 5 is a side view of a switching mechanism unit of FIG. 3. A lower portion of a side plate is cut away. The multi-pole mold case circuit breaker (MCCB) with an insulation barrier for a rotary pin according to an embodiment of the present disclosure will be described in detail with reference to the accompanying drawings.

The multi-pole molded case circuit breaker (MCCB) with an insulation barrier for a rotary pin according to an embodiment of the present disclosure, including a shaft assembly 10 in which a movable contactor 11 is provided and a plurality of rotary pin holes are provided in a penetrating manner, a base assembly 21 which the shaft assembly 10 is rotatably accommodated in and coupled to, a switching mechanism 30 coupled to an upper portion of the base assembly 21 and rotating the shaft assembly 10, and a plurality of rotary pins 12 coupled to the plurality of rotary pin holes 15 in a penetrating manner, further includes an insulation barrier 40 formed of an insulating material and provided to cover the plurality of rotary pins 12.

The multi-pole MCCB includes a plurality of single pole breaking units 20 to open and close circuits of phases (for example, R phase, S phase, and T phase in the case of three phases). The plurality of single pole breaking units 20 may be placed abreast in parallel. For example, an R phase single pole breaking unit 20(R), an S phase single pole breaking unit 20(S), and a T phase single pole breaking unit 20(T) may be placed in order. The single pole breaking unit 20 includes the shaft assembly in which the movable contact 11 and the rotary pin 12 are installed and the base assembly 221 formed of an insulating material and accommodating a contact unit, an arc extinguishing unit, and a terminal unit. Any one single pole breaking unit 20 (in general, the S pole breaking unit) may have a switching mechanism 30 providing power for rotating the shaft assembly 10. An enclosure of the MCCB is not illustrated and may refer to that of the related art illustrated in the drawings.

The base assembly 21 provides a space for accommodating the movable contactor 11 and the fixed contactor 16 to perform a breaking operation. The base assembly 21 is formed of an insulating material. The base assembly 21 may be formed as a pair of horizontally separated molds. A terminal unit is provided at each of both end portions of the base assembly 21 in a length direction. Here, a power source side (or a load side) terminal unit 22 is provided at one end and a connection unit 23 connected to a load side (or a power source side) terminal unit (not shown) is provided at the other end.

A switching mechanism 30 is coupled to the base assembly 21 of the S-pole breaking unit. The switching mechanism 30 includes a pair of side plates 31 installed on both sides of the base assembly 21, a handle 32 to which the user may manually apply a force, a handle lever 33 having a "U" shape, whose upper surface is fixedly coupled to the handle 32 and side surface is rotatably supported by the side plates 31, a nail 34 rotated according to a trip operation of a trip mechanism when an abnormal current occurs, a latch holder 35 supporting a latch 36 and rotated by the nail 34, the latch 36 supporting an upper link (not shown), a main spring 37 transmitting power to a link shaft (not shown), and an upper link (not shown) and a lower link (not shown) movably coupled between the latch 36 and the link shaft.

An operation hole 24 having a circular arc shape in which a pair of rotary pins 12 are operable is formed in the base assembly 21. An operation hole 31*a* communicating with the operation hole 24 of the base assembly 21 is formed in the side plate 31.

The shaft assembly 10 may have a cylindrical shape. The movable contactor 11 is installed in a radial direction in a penetrating manner in the shaft assembly 10. The movable contactor 11 may be provided as a pair symmetrical to the shaft assembly 10. In the shaft assembly 10, a shaft part 13 is formed in a central portion and protrude in a vertical axis direction. A pair of rotary pin holes 15 allowing the rotary pin 12 to be insertedly installed are formed in an axial direction in the shaft assembly 10.

A correction link 19 for correcting a movement of the pair of rotary pins 12 may be provided on an outer side of the side plate 31. Since the lower link (not shown) is connected to any one of the pair of rotary pins 12 to transmit power, the other rotary pin may not simultaneously move. In order to correct this, the correction link 19 is provided. Also, since power is transmitted to a central portion of the rotary pin 12 by the lower link, an end portion of the rotary pin 12 may be bent to cause a breaking time of the R phase or the T phase to be different from that of the S phase. The correction link 19 may also serve to prevent such a bending phenomenon.

Figure 6A:
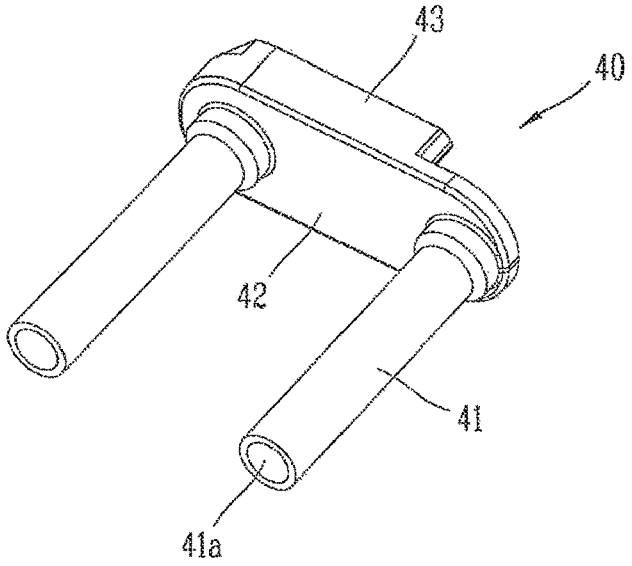
FIGS. 6A and 6B are front and rear perspective views of an insulation barrier for a rotary pin according to an embodiment of the present disclosure.
Figure 6B:
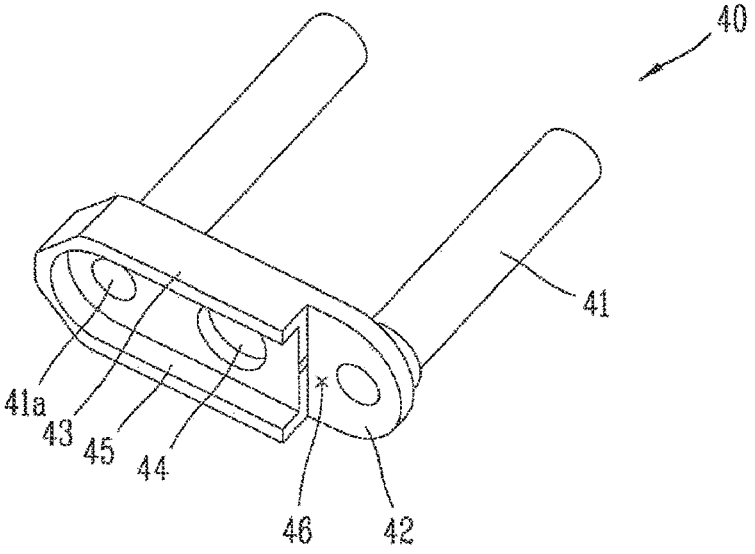

FIGS. 6A and 6B are front and rear perspective views of an insulation barrier for a rotary pin according to an embodiment of the present disclosure.

The insulation barrier 40 may include a pair of pipe parts 41 having a pipe shape and covering the pair of rotary pins 12 and a plate part 42 vertically connected to one end of each of the pair of pipe parts 41. The insulation barrier 40 is formed of an insulating material to prevent dielectric breakdown.

The pipe part 41 may have a pin hole 41*a* allowing the rotary pin 12 to penetrate therethrough so as to be inserted in a length direction.

An outer diameter of the pipe part 41 is preferably formed to be smaller than a diameter of the rotary pin hole 15 of the shaft assembly 10. In other words, the rotary pin hole 15 of the shaft assembly 10 is preferably formed to be larger than an outer diameter of the pipe part 41 of the insulation barrier 40. The pipe part 41 of the insulation barrier 40 is inserted into the rotary pin hole 15 of the shaft assembly 10, and the rotary pin 12 is insertedly installed in the pin hole 41*a* of the pipe part 41.

The pipe part 41 may have a length substantially corresponding to a width of the single pole breaking unit 20. Thus, since the insulation barrier 40 covers the pair of rotary pins 12 within the single pole breaking unit 20, dielectric breakdown in the rotary pin 12 portion within the single pole breaking unit 20 is prevented.

The plate part 42 has a plate shape vertically connecting one ends of the pair of pipe parts 41. A pin hole 41*a* is formed in the plate part 42 and communicates therewith. The plate part 42 has a cover part 43 extending inwardly (the opposite direction of the pipe part) along a circumference to cover the correction link 19 connecting the pair of rotary pins 18. A link insertion recess 45 allowing the correction link 18 to be inserted therein is formed on a rear surface of the plate part 42 by the cover part 43.

A shaft recess 44 is formed on a rear surface of the plate part 42 such that the shaft part 13 of the shaft assembly 10 operates without being interfered.

Meanwhile, a portion of the cover part 43*c* is opened to provide a cutaway part 46. Referring to FIG. 3, the cutaway part 46 may be provided in order to avoid interference with a breaking display lever 18 provided in the any one rotary pin 12 or any other component on an outer side of the correction link 19.

The insulation barrier 40 may be provided in each of the single pole breaking unit 20. The insulation barrier 40 is installed as the pipe part 41 is inserted into the rotary pin hole 15 of the shaft assembly 10. Here, the correction link 19 is inserted into the link insertion recess 45 of the insulation barrier 40 provided in the R phase single pole breaking unit 20(R).

Although not shown, in a state in which the three phase single pole breaking units 20 are all coupled, the insulation barriers 40 thereof are connected in a row and cover the rotary pin 12. Thus, the rotary pin 12 may be maintained in a state of being completely insulated from surroundings.

According to the multi-pole MCCB with an insulation barrier for a rotary pin according to an embodiment of the present disclosure, since the insulation barrier is provided in the rotary pin for inter-phase opening and closing power transmission, dielectric breakdown is prevented.

Also, since the correction link is coupled to the insulation barrier, an operation of correcting movement of the rotary pin is stably performed.

Figure 7A:
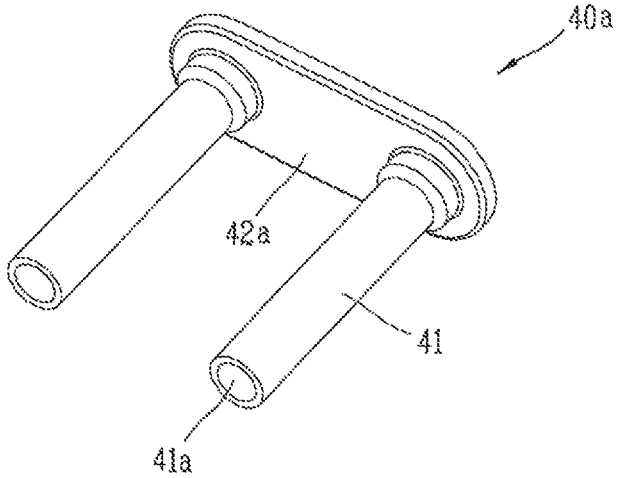
Figure 7B:
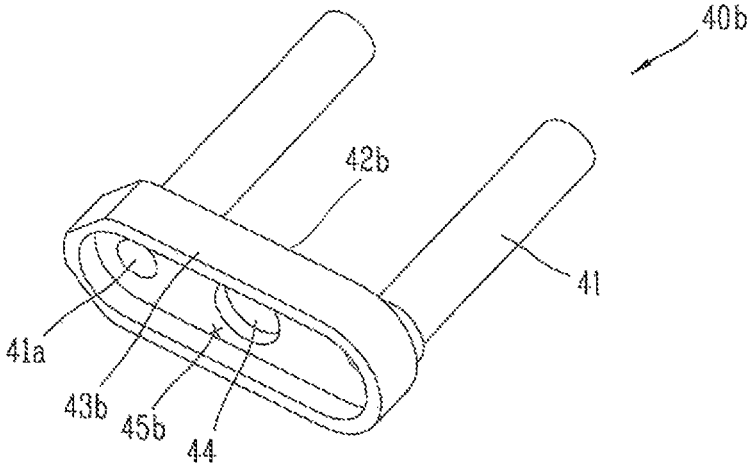
Figure 7C:
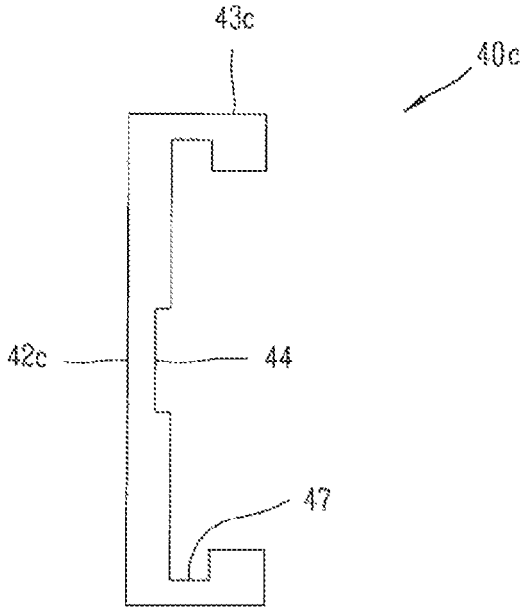

FIGS. 7A to 7C illustrate an insulation barrier for a rotary pin according to another embodiment of the present disclosure. Characteristics of each embodiment will be described with reference to the accompanying drawings.

The pipe part 41 of the insulation barrier 40 of FIG. 7A is the same as that of the previous embodiment, except that the plate part 42*a* is formed to have a flat plate shape. Since the plate part 42*a* has a simple shape, it is easily manufactured and has excellent assembly characteristics.

A pipe part 40*b* of the insulation barrier 40*b* of FIG. 7B is also form to be the same as that of the previous embodiment. A cover part 43*b* is provided on a plate part 42*b* and extends in a direction opposite to a direction of the pipe part 41 along the circumference of the plate part 42*b* to cover the correction link 10.

A link insertion recess 45*b* allowing the correction link 19 to be inserted therein by the cover part 43 is formed on a rear side of the plate part 42. Compared with the link insertion recess 45 of the previous embodiment, a cutaway part is not formed in the cover part 43*b*, and thus, the link insertion recess 45*b* may stably cover the circumference of the correction link 19. According to this embodiment, coupling characteristics of the insulation barrier 40 and the correction link 19 are excellent.

FIG. 7C is a cross-sectional view of a central portion of an insulation barrier 40*c* of FIG. 7C where a shaft recess 44 is provided. The insulation barrier 40*c* is the same as that of the embodiment of FIG. 7B, except for a link circumference recess 47 formed on an inner side of a cover part 43*c* of a plate part 42*c*. Since the link circumference recess 47, allowing the correction link 19 to be inserted therein, formed on the inner side of the cover part 43*c* is provided, the correction link 19 is coupled and supported in both directions. That is, a width (a vertical length in FIG. 7C) of the link circumference recess 47 is equal to a width (a vertical length in FIG. 4) of the correction link 19 and a width of the cover part 43*c* is smaller than the width of the correction link 19, and thus, the correction link 19 may be press-ft to be coupled to the insulation barrier 40. The insulation barrier 40 is coupled to the correction link 19 and does not escape from the rotary pin 12 without an external force. According to the present embodiment, coupling characteristics of the insulation barrier 40 and the correction link 19 are excellent. Thus, a correction operation regarding movement of the rotary pin 12 is excellent.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A multi-pole molded case circuit breaker (MCCB) comprising:

a shaft assembly having a movable contactor and having a plurality of rotary pin holes formed in a penetrating manner;

a base assembly which the shaft assembly is rotatably accommodated in and coupled to;

a switching mechanism coupled to an upper portion of the base assembly and rotating the shaft assembly;

a plurality of rotary pins respectively coupled to the plurality of rotary pin holes in a penetrating manner;

a correction link for correcting a movement of the plurality of rotary pins, wherein the correction link is provided on an outer side of the switching mechanism; and an insulation barrier formed of an insulating material to cover the plurality of rotary pins and the correction link, wherein the insulation barrier includes:

a plurality of pipe parts formed in the form of a pipe to cover the plurality of rotary pins and a plate part vertically connecting one end of each of the plurality of pipe parts to cover the correction link, and wherein the plurality of pipe parts substantially cover an entirety of the length of the rotary pins.

2. The multi-pole MCCB of claim 1, wherein each of the plurality of rotary pin holes and each of the plurality of rotary pins are provided as a pair.

3. The multi-pole MCCB of claim 1, wherein the plate part has a cover part extending in a direction opposite to a direction of the pair of pipe parts along a circumference to cover the correction link connecting the plurality of rotary pins.

4. The multi-pole MCCB of claim 3, wherein a link insertion recess allowing the correction link to be inserted and fixed thereto is formed on an inner side of the cover part.

5. The multi-pole MCCB of claim 3, wherein the cover part has a cutaway part opening a portion of the cover part.

6. The multi-pole MCCB of claim 1, wherein the plurality of rotary pin holes are formed to be greater than an outer diameter of the insulation barrier.

7. The multi-pole MCCB of claim 3, wherein a link circumference recess allowing a circumferential portion of the correction link to be inserted therein is formed on an inner side of the cover part.

8. The multi-pole MCCB of claim 2, wherein a lower link is exposed to a lower side of the switching mechanism, and any one of the plurality of rotary pins is coupled to a hole of the lower link in a penetrating manner.

* * * * *